US011594239B1

(12) United States Patent
Yang et al.

(10) Patent No.: US 11,594,239 B1
(45) Date of Patent: Feb. 28, 2023

(54) DETECTION AND REMOVAL OF WIND NOISE

(71) Applicant: Meta Platforms, Inc., Menlo Park, CA (US)

(72) Inventors: Jun Yang, San Jose, CA (US); Joshua Bingham, Palo Alto, CA (US)

(73) Assignee: Meta Platforms, Inc., Menlo Park, CA (US)

( * ) Notice: Subject to any disclaimer, the term of this patent is extended or adjusted under 35 U.S.C. 154(b) by 0 days.

(21) Appl. No.: 17/549,697

(22) Filed: Dec. 13, 2021

Related U.S. Application Data

(63) Continuation of application No. 16/815,664, filed on Mar. 11, 2020, now Pat. No. 11,217,264.

(51) Int. Cl.

| | |
|---|---|
| ***G10L 21/0232*** | (2013.01) |
| ***H04R 29/00*** | (2006.01) |
| ***G10L 25/51*** | (2013.01) |
| ***H04R 1/40*** | (2006.01) |
| ***H04R 3/00*** | (2006.01) |
| ***H04R 3/04*** | (2006.01) |
| ***G10L 25/90*** | (2013.01) |
| ***G10L 25/18*** | (2013.01) |
| ***G10L 25/21*** | (2013.01) |
| *G10L 21/0208* | (2013.01) |
| *G10L 21/0216* | (2013.01) |

(52) U.S. Cl.

CPC ..... *G10L 21/0232* (2013.01); *G10L 25/18* (2013.01); *G10L 25/21* (2013.01); *G10L 25/51* (2013.01); *G10L 25/90* (2013.01); *H04R 1/406* (2013.01); *H04R 3/005* (2013.01); *H04R 3/04* (2013.01); *H04R 29/005* (2013.01); *G10L 2021/02085* (2013.01); *G10L 2021/02166* (2013.01); *H04R 2410/07* (2013.01)

(58) Field of Classification Search

None

See application file for complete search history.

(56) References Cited

U.S. PATENT DOCUMENTS

| | | | | |
|---|---|---|---|---|
| 9,343,056 | B1 * | 5/2016 | Goodwin | G10K 11/002 |
| 9,373,340 | B2 * | 6/2016 | Hetherington | G10L 21/0232 |
| 10,249,322 | B2 | 4/2019 | Nelke et al. | |
| 10,341,759 | B2 * | 7/2019 | Dusan | H04R 1/1083 |
| 10,425,731 | B2 * | 9/2019 | Inoue | H04R 3/04 |
| 2004/0161120 | A1 | 8/2004 | Petersen et al. | |
| 2012/0140946 | A1 | 6/2012 | Yen et al. | |

(Continued)

*Primary Examiner* — Paul W Huber

(74) *Attorney, Agent, or Firm* — Fenwick & West LLP

(57) ABSTRACT

An electronic device includes one or more microphones that generate audio signals and a wind noise detection subsystem. The electronic device may also include a wind noise reduction subsystem. The wind noise detection subsystem applies multiple wind noise detection techniques to the set of audio signals to generate corresponding indications of whether wind noise is present. The wind noise detection subsystem determines whether wind noise is present based on the indications generated by each detection technique and generates an overall indication of whether wind noise is present. The wind noise reduction subsystem applies one or more wind noise reduction techniques to the audio signal if wind noise is detected. The wind noise detection and reduction techniques may work in multiple domains (e.g., the time, spatial, and frequency domains).

20 Claims, 5 Drawing Sheets

(56) References Cited

U.S. PATENT DOCUMENTS

| | | | |
|---|---|---|---|
| 2012/0310639 | A1 | 12/2012 | Konchitsky |
| 2013/0308784 | A1 | 11/2013 | Dickins et al. |
| 2015/0213811 | A1 | 7/2015 | Elko et al. |
| 2018/0090153 | A1 | 3/2018 | Hosh et al. |
| 2018/0277138 | A1 | 9/2018 | Kudryavtsev et al. |
| 2019/0043520 | A1 | 2/2019 | Kar et al. |

* cited by examiner

DETECTION AND REMOVAL OF WIND NOISE

CROSS REFERENCE TO RELATED APPLICATIONS

This application is a continuation of co-pending U.S. application Ser. No. 16/815,664, filed Mar. 11, 2020, which is incorporated by reference in its entirety.

FIELD OF INVENTION

The present disclosure relates generally to audio signal processing and, in particular, to holographic detection and removal of wind noise.

BACKGROUND

People use mobile electronic devices that include one or more microphones outdoors. Example of such devices include augmented realty (AR) devices, smart phones, mobile phones, personal digital assistants, wearable devices, hearing aids, home security monitoring devices, and tablet computers, etc. The output of the microphones can include a significant amount of noise due to wind, which significantly degrades the sound quality. In particular, the wind noise may result in microphone signal saturation at high wind speeds and cause nonlinear acoustic echo. The wind noise may also reduce performance of various audio operations, such as acoustic echo cancellation (AEC), voice-trigger detection, automatic speech recognition (ASR), voice-over internet protocol (VoIP), and audio event detection performance (e.g., for outdoor home security devices). Wind noise has long been considered a challenging problem and an effective wind noise removal and detection system is highly sought after for use in various applications.

SUMMARY

A mobile electronic device such as a smartphone includes one or more microphones that generate one or more corresponding audio signals. A wind noise detection (WND) subsystem analyzes the audio signals to determine whether wind noise is present. The audio signals may be analyzed using multiple techniques in different domains. For example, the audio signals may be analyzed in the time, spatial, and frequency domains. The WND subsystem outputs a flag or other indicator of the presence (or absence) of wind noise in the set of audio signals.

The WND subsystem may be used in conjunction with a wind noise reduction (WNR) subsystem. If the WND subsystem detects wind noise, the WNR subsystem processes the audio signals to remove or mitigate the wind noise. The WNR subsystem may process the audio signals using multiple techniques in one or domains. The WNR subsystem outputs the processed audio for use in other applications or by other devices. For example, the output from the WNR subsystem may be used for phone calls, controlling electronic security systems, activating electronic devices, and the like.

Figure 1:
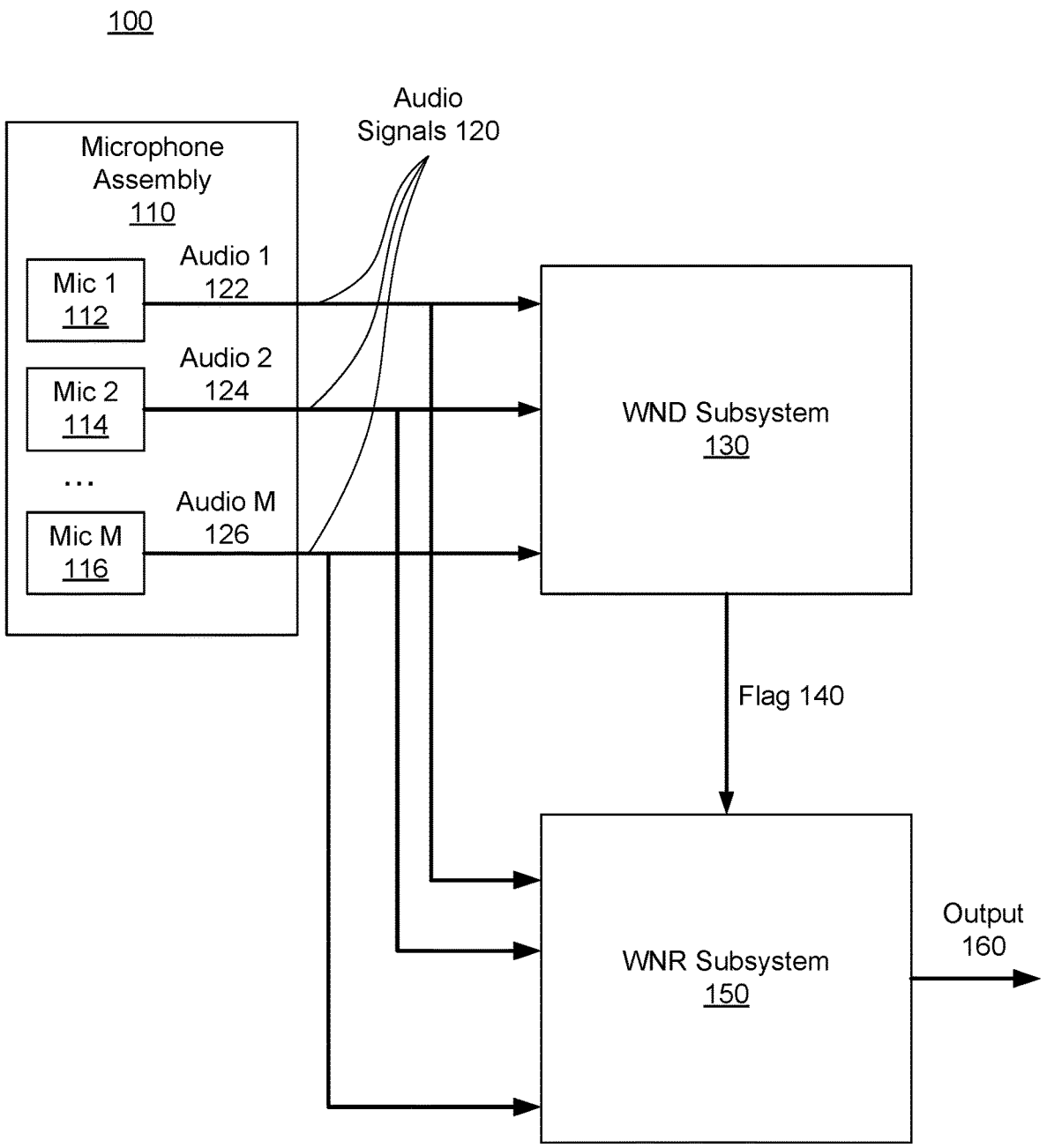
FIG. 1 is a block diagram of a wind nose detection and removal system using multiple microphones, according to one embodiment.

The figures depict various embodiments for purposes of illustration only. One skilled in the art will readily recognize from the following discussion that alternative embodiments of the structures and methods illustrated herein may be employed without departing from the principles described.

DETAILED DESCRIPTION

Introduction

Wind noise in the output from a microphone is statistically complicated and typically has highly non-stationary characteristics. As a result, traditional background noise detection and reduction approaches often fail to work properly. This presents a problem for the use of mobile electronic devices in windy conditions as the wind noise may obscure desired features of the output of microphones, such as an individual's voice.

Potential approaches to wind noise detection (WND) include a negative slope fit (NSF) approach, and neural network (NN) or machine leaning (ML) based approaches. The NSF approach of WND assumes that wind noise can be approximated as decaying linearly in frequency domain. The linear decay assumption may cause the detection indicator to be inaccurate. NN and ML based wind noise detection approaches often require extensive training to discern wind noise from an audio signal of interest, which can be impractical in some scenarios, particularly where a wide variety of audio signals are of intertest. For example, to support various types of wind and voice signals, noise-aware training involves developing consistent estimate of noise, which is often very difficult with highly non-stationary wind noise.

Some potential approaches to wind noise reduction (WNR) include a non-negative sparse coding, a singular value decomposition (SVD) approach and a generalized SVD (GSVD) subspace method. The non-negative sparse coding approach of WNR converges very slow in order to get the stable results and only works if the signal-to-noise ratio (SNR) larger than 0.0 decibel (dB), which is not the case in many practical situations. However, SVD and GSVD approaches are often too complex to implement for low-power devices and are therefore unusable in many practical applications.

Wind noise is increasingly disruptive to audio signals as the associated wind speed increases. Wind noise spectrum falls off as 1/f, where f is frequency. Thus, wind noise has a strong effect on low frequency audio signals. The frequency above which wind noise is not significant increases as the wind speed increase. For example, for wind speeds up to 12 mph, the resulting wind noise is typically significant up to about 500 Hz. For higher wind speeds (e.g., 13 to 24 mph), the wind noise can significantly affect the output signal up to approximately 2 kHz. Existing approaches for WND and WNR fail to provide the desired detection and reduction accuracies in the presence of high-speed wind. However, many practical applications involve use of microphones in outdoor environments where such winds are expected.

In various embodiments, a holographic WND subsystem analyzes multiple signals generated from microphone outputs to detect wind noise. These signals may correspond to analysis in two or more of the time domain, the frequency domain, and the spatial domain. The Holographic WNR subsystem processes the output from one or more microphones to reduce wind noise. The processing techniques may modify the microphone output in two or more of the time domain, the frequency domain, and the spatial domain. The holographic WND and WNR subsystems can be user-configurable to support voice-trigger, ASR, and VoIP human listener applications. For example, in one embodiment, the WNR subsystem can be configured to focus on the wind noise reduction only in the low frequency range up to 2 kHz for voice-trigger and ASR applications so that voice signal remains uncorrupted from 2 kHz. As another example, for a VoIP human listener application, embodiments of the WNR subsystem can be configured to reduce wind noise up to 3.4 kHz for narrowband voice calls and up to 7.0 kHz for wideband voice calls.

System Overview

FIG. 1 illustrates one embodiment of a wind nose detection and removal (WNDR) system 100. The WNDR system 100 may be part of a computing device such as a tablet, smartphone, VR headset, or laptop, etc. In the embodiment shown, the WNDR system 100 includes a microphone assembly 110, a WND subsystem 130, and a WNR subsystem 150. In other embodiments, the WNDR system 100 may contain different or additional elements. In addition, the functions may be distributed among the elements in a different manner than described. For example, the WNR subsystem 150 may be omitted and the output of the WND system 130 used for other purposes.

The microphone assembly 110 includes M microphones: microphone 1 112 and microphone 2 114 through microphone M 116. M may be any positive integer greater than or equal to two. The microphones 112, 114, 116 each have a location and orientation relative to each other. That is, the relative spacing and distance between the microphones 112, 114, 116 is pre-determined. For example, the microphone assembly 110 of a smartphone might include a stereo pair on the left and right edges of the device pointing forwards and a single microphone on the back surface of the device.

The microphone assembly 110 outputs audio signals 120 that are analog or digital electronic representations of the sound waves detected by the corresponding microphones. Specifically, microphone 1 112 outputs audio signal 1 122, microphone 2 114 outputs audio signal 2 124, and microphone M 116 outputs audio signal M 126. In one embodiment, the individual audio signals 122, 124, 126 are composed of a series of audio frames. The m-th frame of an audio signal can be defined as [x(m, 0), x(m, 1), x(m, 2), . . . , x(m, L−1)] (where L is the frame length in units of samples).

The WND subsystem 130 receives the audio signals 120 from the microphone assembly 110 and analyze the audio signals to determine whether a significant amount of wind noise is present. The threshold amount of wind noise above which it is considered significant may be determined based on the use case. For example, if the determination of the presence of significant wind noise is used to trigger a wind noise reduction process (e.g., by the WNR subsystem 150), the threshold amount that is considered significant may be calibrated to balance the competing demands of improving the user experience and making efficient use of the device's computational and power resources. In one embodiment, the WND subsystem 130 analyzes the audio signals 120 in two or more of the time domain, the frequency domain, and the spatial domain. The WND subsystem 130 outputs a flag 140 that indicating whether significant wind noise is present in the audio signals 120. Various embodiments of the WND subsystem 130 are described in greater detail below, with reference to FIG. 2.

The WNR subsystem 150 receives the flag 140 and the audio signals 120. If the flag 140 indicates the WND subsystem 130 determined wind noise is present in the audio signals 120, the WNR subsystem 150 implements one or more techniques to reducing the wind noise. In one embodiment, the wind reduction techniques used are in two or more of the time domain, the frequency domain, and the spatial domain. The WNR subsystem 150 generates an output 160 that includes the modified audio signals 120 with reduced wind noise. In contrast, if the flag 140 indicates the WND subsystem 130 determined wind noise is not present, the WNR subsystem 150 has no effect on the audio signals 120. That is, the output 160 is the audio signals 120. Various embodiments of the WNR subsystem 150 are described in greater detail below, with reference to FIG. 3.

Wind Noise Detection Subsystem

Figure 2:
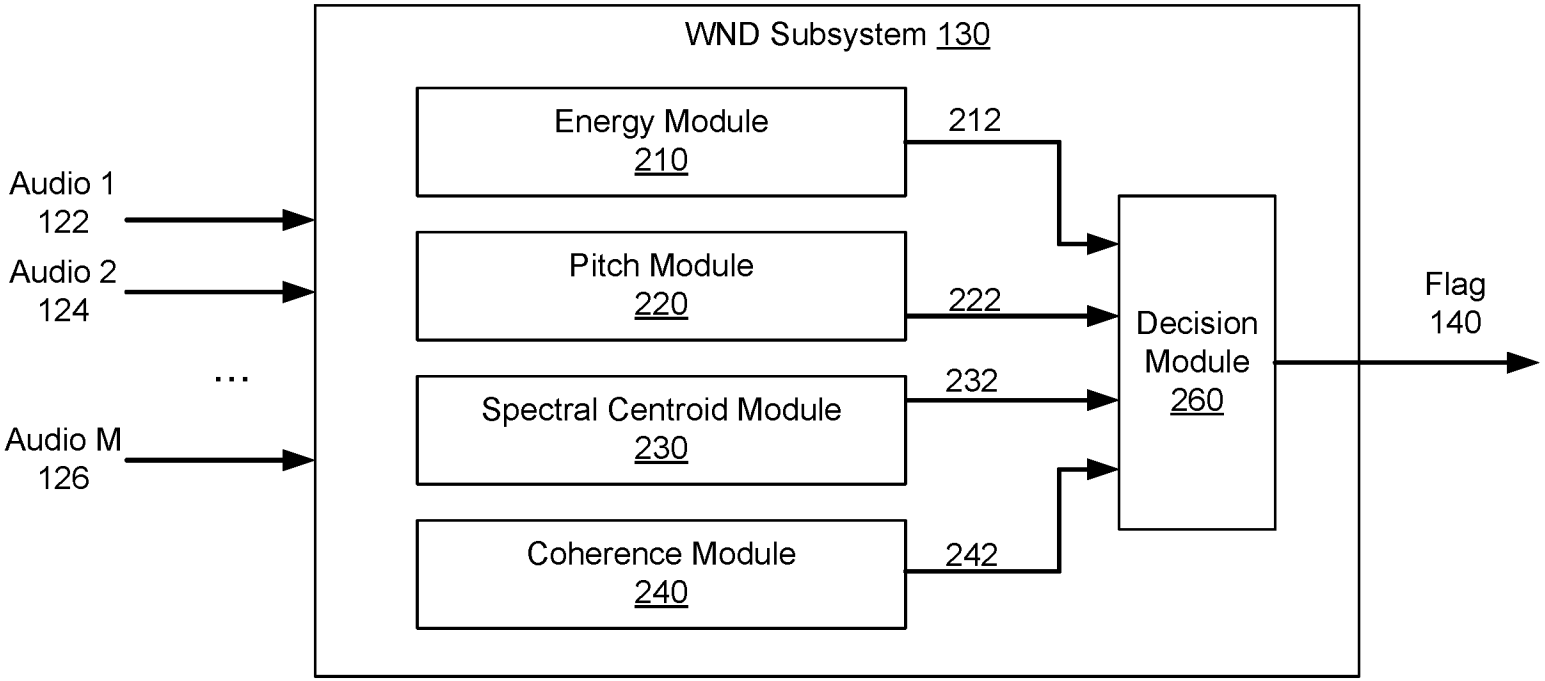
FIG. 2 is a block diagram of the wind noise detection subsystem of FIG. 1, according to one embodiment.

FIG. 2 illustrates one embodiment of the WND subsystem 130. In the embodiment shown, the WND subsystem 130 includes an energy module 210, a pitch module 220, a spectral centroid module 230, a coherence module 240, and a decision module 260. In other embodiments, the WND subsystem 130 may contain different or additional elements. In addition, the functions may be distributed among the elements in a different manner than described.

The WND subsystem 130 receives M audio signals 120, where M can be any positive integer greater than one. The energy module 210, the pitch module 220, the spectral centroid module 230, and the coherence module 240 each analyze the audio signals 120, make a determination as to whether significant wind noise is present, and produce an output indicating the determination made. The decision module 260 analyzes the outputs of the other modules and determines whether wind noise is present in the audio signals 120.

The energy module 210 performs analysis in the time domain to determine whether wind noise is present based on the energies of the audio signals 120. In one embodiment, the energy module 210 processes each frame of the audio signals 120 to generate a filtered signal [y(m, 0), y(m, 1), y(m, 2), . . . , y(m, L−1)]. The processing may include applying a low-pass filter (LPF), such as a 100 Hz second-order LPF (since wind noise energy dominates in frequencies lower than 100 Hz where both wind noise and voice are present together). The energies of the filtered signal and the original signal (i.e., $E_{low}$ and $E_{total}$) are calculated by the energy module 210 as follows:

$$E_{low}(m) = \frac{1}{L}\sum_{n=0}^{L-1}[y(m, n)]^2 \tag{1}$$

$$E_{total}(m) = \frac{1}{L}\sum_{n=0}^{L-1}[x(m, n)]^2 \tag{2}$$

The ratio $r_{ene}(m)$ between $E_{low}(m)$ and $E_{total}(m)$ may be calculated by the energy module 210 as follows:

$$r_{ene}(m) = \frac{E_{low}(m)}{E_{total}(m)} \tag{3}$$

In some embodiments, the energy module 210 smooths the ratio $r_{ene}(m)$ as follows:

$$r_{ene,sm}(m)=r_{ene,sm}(m-1)+\alpha*(r_{ene}(m)-r_{ene,sm}(m-1)) \quad (4)$$

where $\alpha$ is a smoothing factor and ranges from 0.0 to 1.0. This may increase the robustness of feature extraction. If the smoothed ratio $r_{ene,sm}(m)$ (or, if smoothing is not used, the unsmoothed ratio, $r_{ene}(m)$) is larger than an energy threshold (e.g., 0.45), the energy module 210 determines that frame m of the associated audio signal includes significant wind noise. If more than a threshold number (e.g., M/2) of the audio signals 210 indicate the presence of significant wind noise for a given frame, the energy module 210 outputs an indication 212 (e.g., a flag) that it has detected wind noise.

The pitch module 220 performs analysis in the time domain to determine whether wind noise is present based on the pitches of the audio signals 120. Wind noise generally does not have an identifiable pitch, so extracting pitch information from an audio signal can distinguish between wind noise and desired sound (e.g., a human voice). In one embodiment, each of the audio signals 120 is processed by a 2 kHz LPF, and the pitch $f_0$ is estimated using an autocorrelation approach on the filtered signal. The obtained autocorrelation values may be smoothed over time. If a smoothed autocorrelation value (or unsmoothed value, if smoothing is not used) for a given frame of an audio signal is smaller than an autocorrelation threshold (e.g., 0.40), the pitch module 220 determines that significant wind noise is present in the given frame of the audio signal. If more than a threshold number (e.g., M/2) of the audio signals 120 indicate the presence of significant wind noise for the given frame, the pitch module 220 outputs an indication 222 (e.g., a flag) that it has detected wind noise.

The spectral centroid module 230 performs analysis in the frequency domain to determine whether wind noise is present based on the spectral centroids of the audio signals 120. The spectral centroid of an audio signal is correlated to the corresponding sound's brightness. Wind noise generally has a lower spectral centroid than desired sound. In various embodiments, each of the audio signals has a sampling rate, fs, in Hertz (Hz). The audio signals are processed using an N-point fast Fourier transform (FFT). For example, in one embodiment, fs=16 kHz and N=256.

The frequency resolution $\Delta f$ is given by fs/N. Thus, the frequency at the J-th bin is given by $f_J=J*\Delta f$. This enables the bin in which a given frequency is placed to be calculated. For example, the 2.0 kHz frequency is in the J-th bin which can be obtained by the following equation:

$$J=\text{integer of } (2000.0/\Delta f) \quad (5)$$

In one embodiment, the spectral centroid $f_{sc}(m)$ in the m-th frame is calculated as follows:

$$f_{sc}(m)=\frac{\sum_{k=0}^{J} f(k)X(m,k)}{\sum_{k=0}^{J} X(m,k)} \quad (6)$$

where X(m, k) represents the magnitude spectrum of the time domain signal in the m-th frame at the k-th bin, and f(k) is the frequency of the k-th bin (i.e., $f(k)=k*\Delta f$). Alternatively, the spectral centroid $f_{sc}$ may be calculated by replacing the magnitude spectrum by the power spectrum in Equation (6).

In some embodiments, the spectral centroid module 230 smooths $f_{sc}(m)$ as follows:

$$f_{sc,sm}(m)=f_{sc,sm}(m-1)+\beta*(f_{sc}(m)-f_{sc,sm}(m-1)) \quad (7)$$

where $\beta$ is a smoothing factor and ranges from 0.0 to 1.0. If the smoothed spectral centroid $f_{sc,sm}(m)$ (or, if smoothing is not used, the unsmoothed spectral centroid, $f_{sc}(m)$) for a given frame of an audio signal is less than a spectral centroid threshold (e.g., 40 Hz), the spectral centroid module 230 determines significant wind noise is present in the given frame of the audio signal. If more than a threshold number (e.g., M/2) of the audio signal 120 indicate the presence of significant wind noise for the given frame, the spectral centroid module 230 outputs an indication 232 (e.g., a flag) that it detected wind noise.

The coherence module 240 performs analysis in the spatial domain to determine whether wind noise is present based on the coherence between audio signals 120. In various embodiments, coherence is a metric indicating the degree of similarity between a pair of audio signals 120. Wind noise generally has very low coherence at lower frequencies (e.g., less than 6 kHz), even for relatively small spatial separations. For example, wind noise is typically incoherent between two microphones separated by 1.8 cm to 10 cm, with the coherence value of wind noise being close to 0.0 for frequencies up to 6 kHz, in contrast to larger values (e.g., above 0.25) for desired sound. The coherence metric may be in a range between 0.0 and 1.0, with 0.0 indicating no coherence and 1.0 indicating the pair of audio signals are identical. Other ranges of correlation values may be used.

In one embodiment, coherence module 240 calculates a set of coherence values at one or more frequencies in a range of interest (e.g., 0 Hz to 6 kHz) for each pair of audio signals 120. Thus, with M audio signals 120, there are K sets of coherence values, with K defined as follows:

$$K=\binom{M}{2}=\frac{M(M-1)}{2(2-1)}=\frac{M(M-1)}{2} \quad (8)$$

The coherence between a pair of audio signals 120 (e.g., x(t) and y(t)) may be calculated as follows:

$$C_{xy}(f)=\frac{|G_{xy}(f)|^2}{G_{xx}(f)G_{yy}(f)} \quad (9)$$

where $G_{xy}(f)$ is the cross-spectral density (CSD) (or cross power spectral density (CPSD)) between microphone signals x(t) and y(t), and $G_{xx}(f)$ and $G_{yy}(f)$ are the auto-spectral density of x(t) and y(t), respectively. The CSD or CPSD is the Fourier transform of the cross-correlation function, and the auto-spectral density is the Fourier transform of the autocorrelation function.

If a predetermined proportion (e.g., all) of the set of coherence values for a given frame of a pair of audio signals 120 are less than a coherence threshold (e.g., 0.25), this indicates that wind noise is present because wind noise generally results in lower coherence values than desired sound. If more than a threshold proportion (e.g., K/2) of the pairs of audio signals 120 indicate the presence of wind noise in the given frame, the coherence module 240 outputs an indication 242 (e.g., a flag) that it detected wind noise.

The decision module 260 receives output from the other modules and determines whether it is likely that significant wind noise is present in frames. In FIG. 2, the decision module 260 receives four indications regarding the presence of wind noise for a frame: an energy-based indication 212, a pitch-based indication 222, a spectral centroid-based indication 232, and a coherence-based indication 242. However, the decision module 260 may receive fewer, additional, or different indications.

In one embodiment, the decision module 260 determines wind noise is likely present if at least a threshold number of the indications (e.g., at least half) indicate the presence of wind noise for a given frame. If the decision module 260 makes such a determination, it outputs a flag 140 or other indication of the presence of wind noise. In the case of FIG. 2, if two or more of the indications 212, 222, 232, 242 correspond to wind noise, the decision module 260 outputs a flag 140 indicating wind noise has been detected. In other embodiments, other techniques for processing the indications 212, 222, 232, 242 may be used. For example, the wind noise determination module 260 can use more complex rules, such as determining wind noise is likely present if the energy-based indication 212 and one other indication 222, 232, 242 indicate wind noise or all three of the other indications indicate wind noise.

Wind Noise Reduction Subsystem

Figure 3:
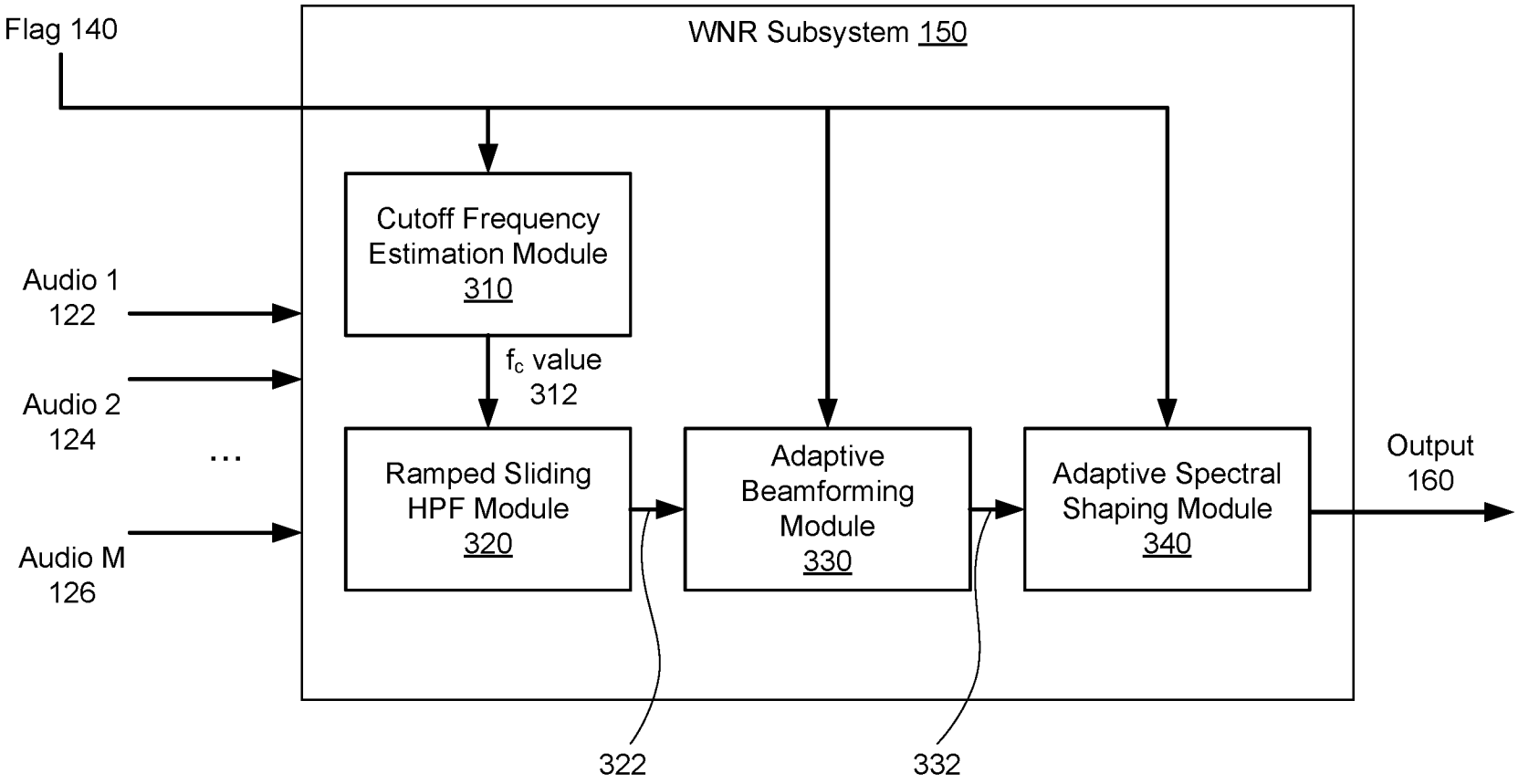
FIG. 3 is a block diagram of the wind noise reduction subsystem of FIG. 1, according to one embodiment.

FIG. 3 illustrates one embodiment of the WNR subsystem 150. In the embodiment shown, the WNR subsystem 150 includes a cutoff frequency estimation module 310, a ramped sliding HPF module 320, an adaptive beamforming module 330, and an adaptive spectral shaping module 340. In other embodiments, the WNR subsystem 150 may contain different or additional elements. In addition, the functions may be distributed among the elements in a different manner than described.

The WNR subsystem 150 receives the flag 140 (or other indication of wind noise) generated by the WND subsystem 130. The flag 140 is passed to one or more modules to initiate processing in one or more domains to reduce the wind noise in the audio signals 120 (e.g., the first audio signal 122, second audio signal 124, and mth audio signal 126). In the embodiment shown in FIG. 3, the audio signals 120 are processed in the time domain, then the spatial domain, and then the frequency domain to generate reduced-noise audio signals as output 160. In other embodiments, the audio processing in some of the domains may be skipped and the processing may be performed in different orders.

Processing in the time domain is performed by the cutoff frequency estimation module 310 and the ramped sliding HPF module 320. The cutoff frequency estimation module 310 estimates a cutoff-frequency, $f_c$, for use in the time domain processing. In one embodiment, if the flag 140 indicates wind noise is not present, the cutoff frequency estimation module 310 sets $f_c$ as 80 Hz. If the flag 140 indicates wind noise is present, the cutoff frequency estimation module 310 calculates a cumulative energy from 80 Hz to 500 Hz for each of the audio signals 120. To reduce computational complexity, either the magnitude spectrum or power spectrum generated by the spectral centroid module 230 may be used to calculate the cumulative energy.

If the cumulative energy of the i-th audio signal (i=1, 2, . . . , M) at frequency $f_{c,i}$ is larger than a cumulative energy threshold (e.g., 200.0), then the $f_{c,i}$ may be chosen as a potential cutoff frequency. The value for $f_c$ may be calculated as follows:

$$f_c = \frac{1}{M}\sum_{i=1}^{M} f_{c,i} \tag{10}$$

Thus, $f_c$ is dynamically adjusted between 80 Hz and 500 Hz.

The ramped sliding HPF module 320 receives the $f_c$ value 312 and slides a ramped high-pass filter (HPF) in the frequency domain based on the $f_c$ value. In one embodiment, the ramped sliding HPF filter is a second order infinite impulse response (IIR) filter parameterized as follows. Define:

$$cs = \cos(2\pi(f_c/f_s))\text{and}$$

$$\gamma = \frac{\sin(2\pi(f_c/f_s))}{2Q}$$

where Q is the quality factor (e.g., Q=0.707). The filter coefficients can then be defined as:

b1=−(1.0+cs)
b0=−b1/2.0
b2=b0
a0=1.0+γ
a1=−2.0*cs
a2=1.0−γ

The filter coefficients may be normalized as follows:

$$\text{HPF numerator } B=[b0/a0\, b1/a0\, b2/a0] \tag{11}$$

$$\text{HPF denominator } A=[1.0\, a1/a0\, a2/a0] \tag{12}$$

In one embodiment, when the flag 140 indicates wind noise is present, the ramped sliding HPF module 320 linearly ramps the filter coefficients on each processed audio sample according to coefficient increments (e.g., 0.01). The original A and B vectors of the coefficients are kept unchanged. The increments and the ramping length may be selected such that the filter coefficients reach their final value at the end of the ramping. At the end of ramping, the ramping function may be set to bypass mode, and thus uses the original A and B vectors, to reduce the computational complexity. Generally, each of the audio signals 120 is processed by the same ramped dynamic sliding HPF although, in some embodiments, one or more audio signals may be processed differently.

The adaptive beamforming module 330 processes the audio signals 120 in the spatial domain using an adaptive beam-former. In one embodiment, a differential beamformer is used. The differential beamformer may boost signals that have low correlation between the audio signals 120, particularly at low frequencies. Therefore, a constraint or regulation rule may be used to determine the beamformer coefficients to limit wind noises with having low correlation at low frequencies. This results in differential beams that have omni patterns below a threshold frequency (e.g., 500 Hz).

In another embodiment, the adaptive beamforming module 330 uses a minimum variance distortionless response (MVDR). The signal-to-noise ratio (SNR) of the output of this type of beamformer is given by:

$$SNR = \frac{E[|W^H S|^2]}{E[|W^H N|^2]} = \frac{\sigma_s^2 |W^H a(\theta)|^2}{W^H R_n W} \tag{13}$$

where W is a complex weight vector, H denotes the Hermitian transform, $R_n$ is the estimated noise covariance matrix, $\sigma_s^2$ is the desired signal power, and a is a known steering vector at direction θ. The beamformer output signal at time instant n can be written as $y(n)=W^H x(n)$.

In the case of a point source, the MVDR beamformer may be obtained by minimizing the denominator of the above SNR Equation (13) by solving the following optimization problem:

$$\min_w(W^H R_n W) \text{ subject to } W^H a(\theta)=1 \quad (14)$$

where $W^H a(\theta)=1$ is the distortionless constraint applied to the signal of interest.

The solution of the optimization problem (14) can be found as follows:

$$W=\lambda R_n^{-1} a(\theta) \quad (15)$$

where $(\cdot)^{-1}$ denotes the inverse of a positive definite square matrix and X is a normalization constant that does not affect the output SNR Equation (13), which can be omitted in some implementations for simplicity.

Regardless of the specific type of beam former and parameterization approach used, the adaptive beamforming module 330 applies the adaptive beamformer to the audio signals 120 to compensate for the wind noise.

The adaptive spectral shaping module 340 processes the audio signals 120 in the frequency domain using a spectral filtering approach (spectral shaping). The spectral shape of the spectral filter is dynamically estimated from a frame having wind noise. The spectral shaping suppresses wind noise in the frequency domain.

In one embodiment, the spectrum of the estimated clean sound of interest in the frequency domain is modeled as follows:

$$|X(m,k)|^2=H(m,k)*|Y(m,k)|, k=0,1, \ldots ,N/2 \quad (16)$$

where H(m, k) and |Y(m,k)| are the spectral weight and input magnitude spectrum at the k-th bin and in the m-th frame, and N is the FFT length. The wind noise spectral shape $|W(m,k)|^2$ in the m-th frame at the k-th bin can be estimated from the input spectrum when the flag 140 indicates the presence of wind noise. The frequency at the k-th bin is given by $f_k$=k*fs/N (Hz), where fs is the sampling rate.

The frequency domain can be split into two portions by a frequency limit, $f_{Limit}$. Above $f_{Limit}$, adaptive spatial shaping module 340 may perform no (or limited) spectral shaping, while below $f_{Limit}$, spectral shaping may be used to suppress wind noise. For example, without loss of generality, assume that $f_{Limit}$ is 2 kHz, 3.4 kHz, and 7.0 kHz for voice-trigger and ASR applications, narrowband voice calls, and wideband voice calls, respectively. The spectral weight can be set H(m, k)=1.0 under the condition of $f_k \geq f_{Limit}$, otherwise, H(m, k) can be calculated through one of the following suppression rules:

$$\text{Weighted Wiener Filtering}: H(m,k) = 1 - \mu \frac{|W(m,k)|^2}{|Y(m,k)|^2} \quad (17)$$

$$\text{Weighted Power Spectral Substraction}: H(m,k) = \sqrt{1 - \mu \frac{|W(m,k)|^2}{|Y(m,k)|^2}} \quad (18)$$

$$\text{Weighted Magnitude Spectral Substraction}: H(m,k) = 1 - \mu \frac{|W(m,k)|}{|Y(m,k)|} \quad (19)$$

where μ is a weighting parameter between 0.0 and 1.0. The values of spectral weight may be constrained such that 0.0<H(m, k)≤1.0.

Single Audio Input Example

Figure 4:
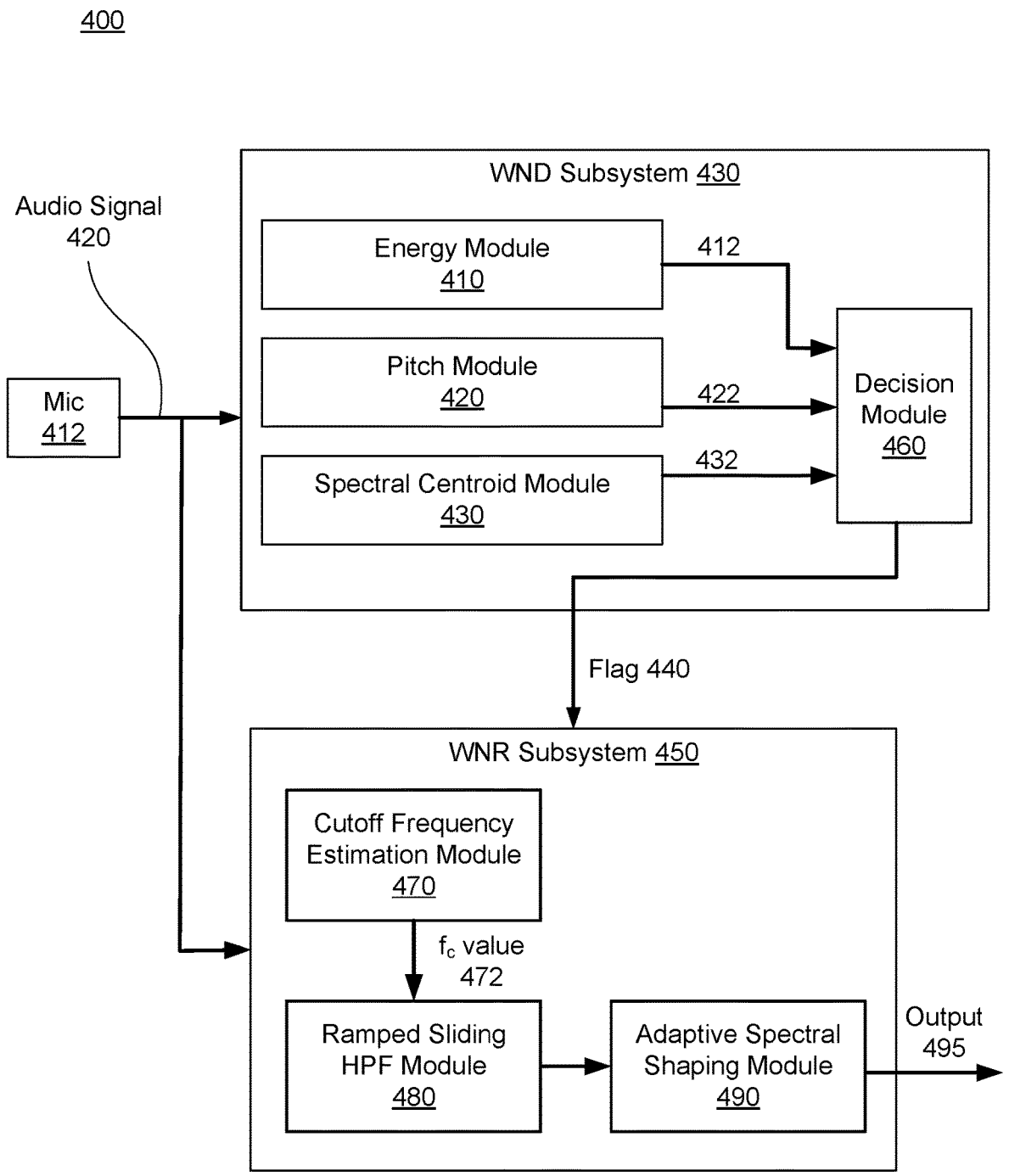
FIG. 4 is a block diagram of a wind noise detection and removal system using a single microphone, according to one embodiment.

FIG. 4 illustrates an alternative embodiment of the WNDR system 400. In the embodiment shown, the WNDR system 400 includes a microphone 412, a WND subsystem 430, and a WNR subsystem 450. In other embodiments, the WNDR system 400 may contain different or additional elements. In addition, the functions may be distributed among the elements in a different manner than described.

Unlike the WNDR system 100 show in FIG. 1, the WNDR system 400 uses a single audio signal 420 from microphone 412. The energy module 410, pitch module 420, and spectral centroid module 430 receive the signal 420 and make a determination as to whether wind noise is present. These modules work in substantially the same way as their counterparts described above with reference to FIG. 1, except that they do not compare a number of audio signals for which wind noise is detected to a threshold. Rather, because only a single audio signal 420 is used, they determine whether wind noise is present in that signal and output a corresponding indication 412, 422, 432 (e.g., a flag).

The decision module 460 makes a determination of whether noise is present based on the indications 412, 422, 432. In one embodiment, the decision module 460 determines wind noise is present if at least two of the indications 412, 422, 432 indicate the corresponding module detected wind noise. In other embodiments, other rules or conditions may be used to determine whether wind noise is present.

The WNR subsystem 450 receives an indication 440 (e.g., a flag) from the decision module 460 indicating whether wind noise is present. The WNR subsystem 450 includes a cutoff frequency estimation module 470 and a ramped sliding HPF module 480 that process the audio signal 420 in the time domain. The WNR subsystem 450 also includes an adaptive spectral shaping module 490 that processes the audio signal in the frequency domain.

The cutoff frequency estimation module 470 determines a cutoff frequency value 472, $f_c$, from the audio signal 420 and the ramped sliding HPF module 480 applies a ramped sliding HPF to the audio signal. These modules operate in a similar manner to their counterparts in FIG. 3 except that they apply time domain processing to a single audio signal 420, rather than multiple audio signals 120. Likewise, the adaptive spectral shaping module 490 processes the audio signal 420 in the frequency domain in a similar manner to its counterpart in FIG. 3.

EXAMPLE METHOD

Figure 5:
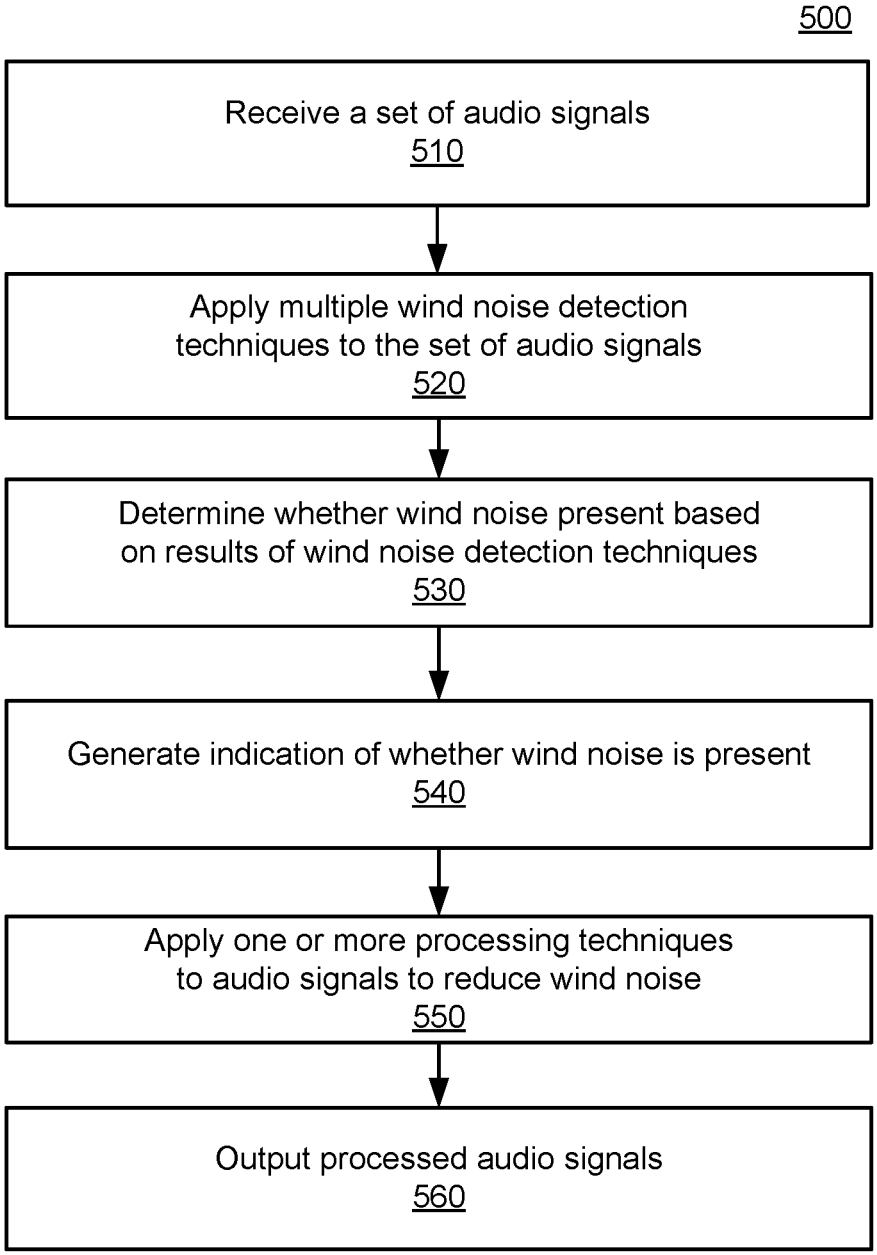
FIG. 5 is a flowchart of a process for detecting and reducing wind noise, according to one embodiment.

FIG. 5 illustrates an example method 500 for detecting and reducing wind noise in one or more audio signals. The steps of FIG. 5 are illustrated from the perspective of various components of the WNDR system 100 performing the method 500. However, some or all of the steps may be performed by other entities or components. In addition, some embodiments may perform the steps in parallel, perform the steps in different orders, or perform different steps.

In the embodiment shown in FIG. 5, the method 500 begins with the WND system 130 receiving 510 a set of audio signals 120. The set may include one or more audio signals (e.g., generated by the microphone assembly 110).

The WND subsystem 130 applies 520 multiple wind noise detection techniques to the set of audio signals 120. Each wind noise detection technique generates a flag or other indication of whether wind noise was determined to be present. For example, as described above with reference to FIG. 2, the WND subsystem 130 may analyze the audio signals based on energy, pitch, spectral centroid, and coherence to generate four flags, each indicating the presence or absence of wind noise.

The WND subsystem 130 determines 530 whether wind noise is present in the audio signals 120 based on flags or other indications generated by the wind noise detection techniques. In one embodiment, the WND subsystem 130 determines 530 that wind noise is present if two or more of the wind detection techniques generate an indication of wind noise. In other embodiments, other rules may be applied to determine 530 whether wind noise is present. Regardless of the precise approach used, the WND subsystem 130 generates 540 an indication of whether wind noise is present in the audio signals 120.

If the WND subsystem 130 determines wind noise is present, the WNR subsystem 150 applies 550 one or more processing techniques to the audio signals 120 to reduce the wind noise. As described previously, with reference to FIG. 3, the audio signals may be processed in one or more domains. For example, the WNR subsystem 150 may apply a ramped sliding HPF in the time domain, an adaptive beamformer in the spatial domain, and adaptive spectral shaping in the frequency domain. The WNR subsystem 150 outputs 560 the processed audio signals 120 for use by other applications or devices.

Additional Configuration Information

The foregoing description of the embodiments has been presented for illustration; it is not intended to be exhaustive or to limit the patent rights to the precise forms disclosed. Persons skilled in the relevant art can appreciate that many modifications and variations are possible considering the above disclosure.

Some portions of this description describe the embodiments in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all the steps, operations, or processes described.

Embodiments may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability. Embodiments may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the patent rights. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

What is claimed is:

1. A method comprising:

receiving a set of audio signals, the set of audio signals including one or more audio signals generated by one or more microphones;

determining whether wind noise is present in the set of audio signals; and responsive to determining that wind noise is present in the set of audio signals, processing the audio signals to reduce the wind noise using a plurality of wind noise reduction processing techniques, the processing comprising:

applying a first processing technique to the set of audio signals to reduce wind noise in the set of audio signals, the first processing technique in a first domain, and applying a second processing technique to an output of the first processing technique, the second processing technique in a second domain different than the first domain.

2. The method of claim 1, wherein the first domain is one of a time domain, a spatial domain, and a frequency domain.

3. The method of claim 1, wherein the plurality of wind noise reduction processing techniques includes a time domain processing technique that comprises:

calculating a cutoff frequency based on cumulative energies of the audio signals;

parametrizing a sliding ramped high-pass filter based on the cutoff frequency, a sampling rate of the audio signals, and a quality factor; and applying the parameterized sliding ramped high-pass filter to the audio signals.

4. The method of claim 1, wherein the plurality of wind noise reduction processing techniques includes a spatial domain processing technique that comprises:

applying an adaptive beam former to the audio signals to reduce wind noise in the audio signals.

5. The method of claim 1, wherein the plurality of wind noise reduction processing techniques includes a frequency domain processing technique that comprises:

estimating a spectrum of desired sound in the audio signals;

configuring a spectral filter based on the estimated spectrum of the desired sound; and applying the spectral filter to the audio signals to reduce the wind noise.

6. The method of claim 1, wherein processing the audio signals further comprises:

applying a third processing technique to an output of the second processing technique, the third processing technique in a third domain different than the first domain and the second domain.

7. The method of claim 1, wherein determining whether wind noise is present in the set of audio signals comprises applying a plurality of wind noise detection techniques to the set of audio signals to generate a corresponding plurality of indications of whether wind noise is present in the set of audio signals.

8. The method of claim 7, wherein determining whether wind noise is present in the set of audio signals further comprises comparing a number of indications from the plurality of indications indicating that wind noise is present in the set of audio signals to a threshold value to determine whether wind noise is present in the set of audio signals.

9. The method of claim 7, wherein applying the plurality of wind noise detection techniques comprises:

applying a first detection technique to analyze the set of audio signals in the first domain, wherein the first detection technique determines, for each audio signal in the set of audio signals, a likelihood that noise is present in the audio signal;

generating a first indication of whether wind noise is present in the set of audio signals based on a number of audio signals having a likelihood that noise is present in the audio signal greater than a first threshold value;

applying a second detection technique to analyze the set of audio signals in a second domain, the second domain different than the first domain; and comparing an output of the second detection technique to a second threshold to generate a second indication of whether wind noise is present in the set of audio signals.

10. A non-transitory computer-readable medium storing computer-executable instructions that, when executed by a computing device, cause the computing device to:

receive a set of audio signals, the set of audio signals including one or more audio signals generated by one or more microphones;

determine whether wind noise is present in the set of audio signals; and responsive to determining that wind noise is present in the set of audio signals, process the audio signals to reduce the wind noise using a plurality of wind noise reduction processing techniques, the processing comprising:

apply a first processing technique to the set of audio signals to reduce wind noise in the set of audio signals, the first processing technique in a first domain, and apply a second processing technique to an output of the first processing technique, the second processing technique in a second domain different than the first domain.

11. The non-transitory computer-readable medium of claim 10, wherein the first domain is one of a time domain, a spatial domain, and a frequency domain.

12. The non-transitory computer-readable medium of claim 10, wherein the plurality of wind noise reduction processing techniques includes a time domain processing technique that comprises:

calculating a cutoff frequency based on cumulative energies of the audio signals;

parametrizing a sliding ramped high-pass filter based on the cutoff frequency, a sampling rate of the audio signals, and a quality factor; and applying the parameterized sliding ramped high-pass filter to the audio signals.

13. The non-transitory computer-readable medium of claim 10, wherein the plurality of wind noise reduction processing techniques includes a spatial domain processing technique that comprises:

applying an adaptive beam former to the audio signals to reduce wind noise in the audio signals.

14. The non-transitory computer-readable medium of claim 10, wherein the plurality of wind noise reduction processing techniques includes a frequency domain processing technique that comprises:

estimating a spectrum of desired sound in the audio signals;

configuring a spectral filter based on the estimated spectrum of the desired sound; and applying the spectral filter to the audio signals to reduce the wind noise.

15. The non-transitory computer-readable medium of claim 10, wherein the instructions for processing the audio signals further cause the computing device to:

apply a third processing technique to an output of the second processing technique, the third processing technique in a third domain different than the first domain and the second domain.

16. The non-transitory computer-readable medium of claim 10, wherein the instructions for determining whether wind noise is present in the set of audio signals cause the computing device to apply a plurality of wind noise detection techniques to the set of audio signals to generate a corresponding plurality of indications of whether wind noise is present in the set of audio signals.

17. The non-transitory computer-readable medium of claim 16, wherein the instructions for determining whether wind noise is present in the set of audio signals further cause the computing device to compare a number of indications from the plurality of indications indicating that wind noise is present in the set of audio signals to a threshold value to determine whether wind noise is present in the set of audio signals.

18. The non-transitory computer-readable medium of claim 16, wherein the instructions for applying the plurality of wind noise detection techniques cause the computing device to:

apply a first detection technique to analyze the set of audio signals in the first domain, wherein the first detection technique determines, for each audio signal in the set of audio signals, a likelihood that noise is present in the audio signal;

generate a first indication of whether wind noise is present in the set of audio signals based on a number of audio signals having a likelihood that noise is present in the audio signal greater than a first threshold value;

apply a second detection technique to analyze the set of audio signals in a second domain, the second domain different than the first domain; and compare an output of the second detection technique to a second threshold to generate a second indication of whether wind noise is present in the set of audio signals.

19. A computing device comprising:

a plurality of microphones configured to generate a set of audio signals;

a wind noise detection subsystem, communicatively coupled to the plurality of microphones, configured to determine whether wind noise is present in the set of audio signals;

apply a plurality of wind noise detection techniques to the set of audio signals;

generate a plurality of indications of whether wind noise is present in the set of audio signals by, for each wind noise detection technique, comparing an output of the wind noise detection technique to a corresponding threshold value to generate an indication of whether wind noise is present in the set of audio signals; and determine whether wind noise is present in the set of audio signals responsive to a number of indications from the plurality of indications indicating that wind noise is present in the set of audio signals being greater than a third threshold value, from the plurality of indications, indicating that wind noise is present in the set of audio signals; and a wind noise reduction subsystem, communicatively coupled to the wind noise detection subsystem, configure to process the audio signals to reduce the wind noise using a plurality of wind noise reduction processing techniques, comprising:

applying a first processing technique to the set of audio signals to reduce wind noise in the set of audio signals, the first processing technique in a first domain, and applying a second processing technique to an output of the first processing technique, the second processing technique in a second domain different than the first domain.

20. The computing device of claim 19, wherein the first domain is one of a time domain, a spatial domain, and a frequency domain.

* * * * *